US006039011A

United States Patent [19]

Agalarov et al.

[11] Patent Number: 6,039,011

[45] Date of Patent: Mar. 21, 2000

[54] INTERNAL COMBUSTION ENGINE WITH OPPOSED PISTONS

[75] Inventors: Jafar Agalarov; Ayten Nasibova; Barat Nuriyev, all of Baku, Azerbaijan

[73] Assignee: The American University of Baku, Azerbaijan

[21] Appl. No.: 09/034,777

[22] Filed: Mar. 4, 1998

Related U.S. Application Data

[60] Provisional application No. 60/038,587, Mar. 5, 1997.

[51] Int. Cl.[7] ..... F02B 25/08

[52] U.S. Cl. ..... 123/51 AA; 123/51 A

[58] Field of Search ..... 123/51 A, 51 AA, 123/658, 197.1, 197.2, 197.3, 197.4, 197.5, 260, 51 BA, 51 BB

[56] References Cited

U.S. PATENT DOCUMENTS

| | | | |
|---|---|---|---|
| 1,889,946 | 12/1932 | Cadwell . | |
| 2,153,899 | 4/1939 | Shover | 123/51 AA |
| 2,255,773 | 9/1941 | Heftler . | |
| 2,840,060 | 6/1958 | Johansson . | |
| 2,853,983 | 9/1958 | Sawle, Jr. . | |
| 4,104,995 | 8/1978 | Steinbock . | |
| 4,375,792 | 3/1983 | Barret . | |
| 4,773,358 | 9/1988 | Heath . | |
| 4,876,992 | 10/1989 | Sobotowski | 123/48 R |
| 5,058,536 | 10/1991 | Johnston | 123/51 BA |
| 5,058,537 | 10/1991 | Paul et al. | 123/51 BA |
| 5,213,067 | 5/1993 | Kramer . | |
| 5,372,215 | 12/1994 | Fukuda | 123/197.1 |
| 5,383,427 | 1/1995 | Tuggle et al. . | |
| 5,595,147 | 1/1997 | Feuling | 123/52.4 |
| 5,680,840 | 10/1997 | Mandella | 123/197.4 |

*Primary Examiner*—Noah P. Kamen
*Assistant Examiner*—Jason Benton
*Attorney, Agent, or Firm*—Dykema Gossett PLLC

[57] ABSTRACT

An internal combustion engine has an engine block has a cylinder defined therein. The cylinder has a longitudinal axis. A first piston and a second piston are disposed within the cylinder. The first piston is directly opposed to the second piston. A first crankshaft is coupled to the first piston. A second crankshaft is coupled to the second piston. The first crankshaft is coupled to the second crankshaft through a plurality of gears. A pocket extends from the cylinder. The pocket defines a dead space therein. The pocket has a first wall spaced apart from a second wall, and a third wall coupled between the first wall and the second wall. The first wall has a first opening. The second wall has a second opening. The third wall has a third opening. A first valve is located within the first opening. A second valve located within the second opening. A spark plug is located within the third opening.

20 Claims, 6 Drawing Sheets

INTERNAL COMBUSTION ENGINE WITH OPPOSED PISTONS

RELATED APPLICATION

The present invention claims priority to provisional application No. 60/038,587 filed on Mar. 5, 1997, which is incorporated by reference herein.

BACKGROUND OF THE INVENTION

The present invention relates generally to an internal combustion engine. More specifically, the present invention relates to an internal combustion engine having horizontally opposed pistons within one cylinder.

Engines, in general, operate as a function of their geometry. Typically, the workings of the engine components are fixed in relation during operation. This relation is not capable of changing during various operating conditions of the engine. The relationship of the various components are thus not optimized over the full operating range of the engine. Typically, the geometry is optimized in a narrow operating range of the engine.

Various engines having horizontally opposed pistons within one cylinder are known. Engines having two horizontally opposed pistons are suitable for many applications. Such engines may be used in four cycle and two cycle applications. The advantage of using two pistons in a single cylinder is that the compression within in the cylinder may be altered by moving one piston with respect to the other. The movement of one piston with respect to the other is known as changing the phase of the pistons. It is desirable to change the phase of the pistons based on the relative speed of the crankshaft. In this manner, the compression of the engine may be changed as desired based on operating conditions of the engine.

One drawback to using two pistons in a single cylinder is the positioning of the valves. The valves are commonly oriented in a direction perpendicular to the axis of the cylinder. This orientation increases the overall size of the block. For many applications space is limited. A larger block also increases the weight of the engine. For reasons of economy, reducing weight is desirable.

Another disadvantage to horizontally opposed pistons within a single cylinder is that a significant amount of dead space is formed around the location of each valve and the location of the spark plug. In many configurations, the valves are located on opposite sides of the cylinder or are spaced apart on the same side of the cylinder. When closed, the valves are spaced back from the cylinder walls to prevent wear. The area directly adjacent the valves is the "dead space". Dead space is the space within the cylinder through which the pistons do not travel. Dead space is an irregular shape and may facilitate the build-up of undesired emissions gases during combustion. Reduction of dead space is therefore desirable.

One example of an engine having horizontally opposed pistons is described in U.S. Pat. No. 1,889,946. The intake and exhaust valves are located in a common dead space located adjacent each other. The dead space in this configuration is quite large and thus undesirable.

SUMMARY OF THE INVENTION

It is therefore one object of the invention to provide an engine configuration having a reduced dead space.

In one aspect of the invention, an engine block has a cylinder defined therein. The cylinder has a longitudinal axis. A first piston and a second piston are disposed within the cylinder. The first piston is directly opposed to the second piston. A first crankshaft is coupled to the first piston. A second crankshaft is coupled to the second piston. The first crankshaft is coupled to the second crankshaft through a plurality of gears. A pocket extends from the cylinder. The pocket defines a dead space therein. The pocket has a first wall spaced apart from a second wall, and a third wall coupled between the first wall and the second wall. The first wall has a first opening. The second wall has a second opening. The third wall has a third opening. A first valve is located within the first opening. A second valve located within the second opening. A spark plug is located within the third opening.

In a further aspect of the invention, a phase shift mechanism is used to change the relative phase of movement of one piston with respect to the other piston.

In yet another aspect of the invention, the phase shift mechanism includes a pair of lever arms and weights that are coupled to a center lever arm. The phase shaft mechanism is centrifugally operated. That is, as the gear to which the phase shift mechanism is coupled rotates, the weights tend outward causing the phase relationship of the crankshafts to be changed.

In still another aspect of the invention, the phase shift mechanism includes a planetary gear arrangement and a carrier. The phase shift mechanism is operated by a synchronizer coupled to the carrier. As the planetary gear arrangement moves with respect to the gear to which it is coupled, the phase of that gear is changed.

One advantage of the present invention is that a relatively small package space is required as compared to the prior art. Less space is require due to the opposed position of the valves.

BRIEF DESCRIPTION OF THE DRAWINGS

Other features and advantages of the present invention will become apparent from the detailed description which should be read in conjunction with the drawing in which:

FIG. 9*a* represents the exhaust portion of the cycle;

FIG. 9*b* is the end of the exhaust cycle in which both valves are closed;

FIGS. 9*c* and 9*d* represent the intake portion of the combustion cycle;

FIGS. 9*e* and 9*f* represent the compression portion of the combustion cycle;

FIG. 9*g* represents the ignition or power portion of the combustion cycle;

FIG. 10*a* represents the end of the exhaust portion of the cycle;

FIG. 10*b* represents the beginning of the intake portion of the cycle;

FIG. 10*c* represents the beginning of the compression portion of the cycle;

FIG. 10*d* represents the end of the compression portion of the cycle;

FIG. 10*e* represents the combustion or power portion of the cycle;

FIG. 10*f* represents the exhaust portion of the cycle;

DETAIL DESCRIPTION OF THE PREFERRED EMBODIMENT

Figure 1:
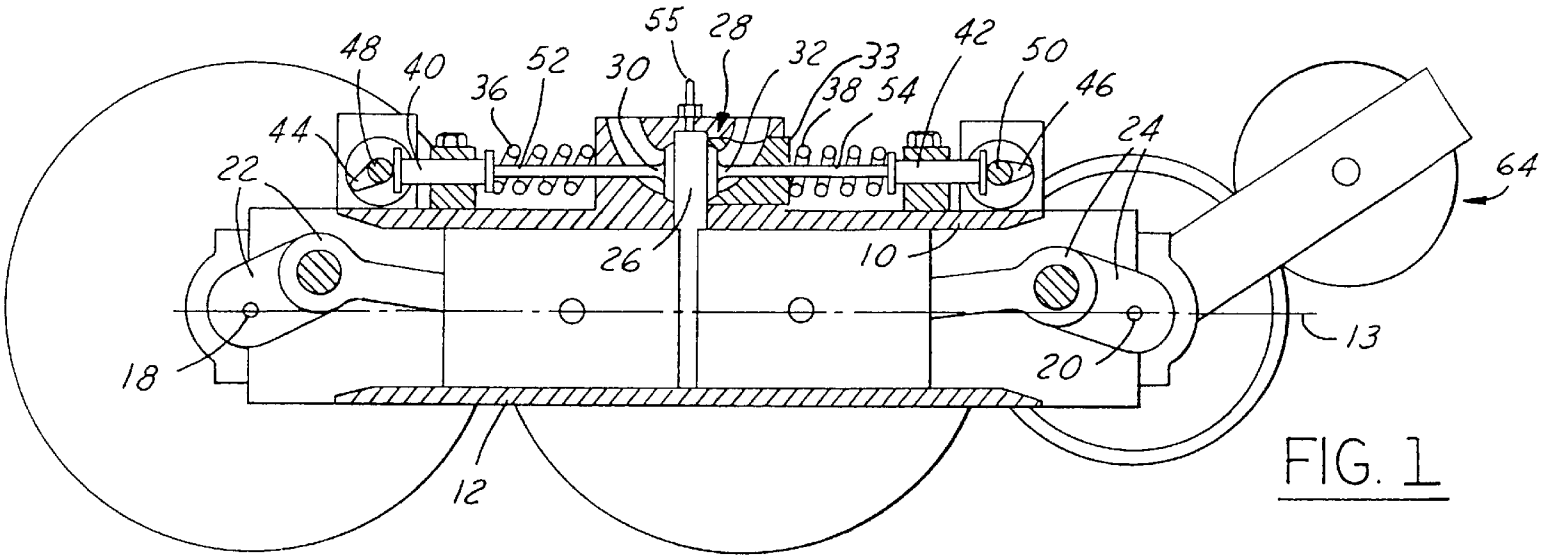
FIG. 1 is a partially cutaway elevational view of a cylinder of an engine with opposed pistons according to the present invention.

Referring now to the drawings, like reference numerals are used to identify identical components in the various views. While the engine is illustrated with respected to a single cylinder, those skilled in the art will recognize that various numbers of cylinders may be used in an engine.

Figure 2:
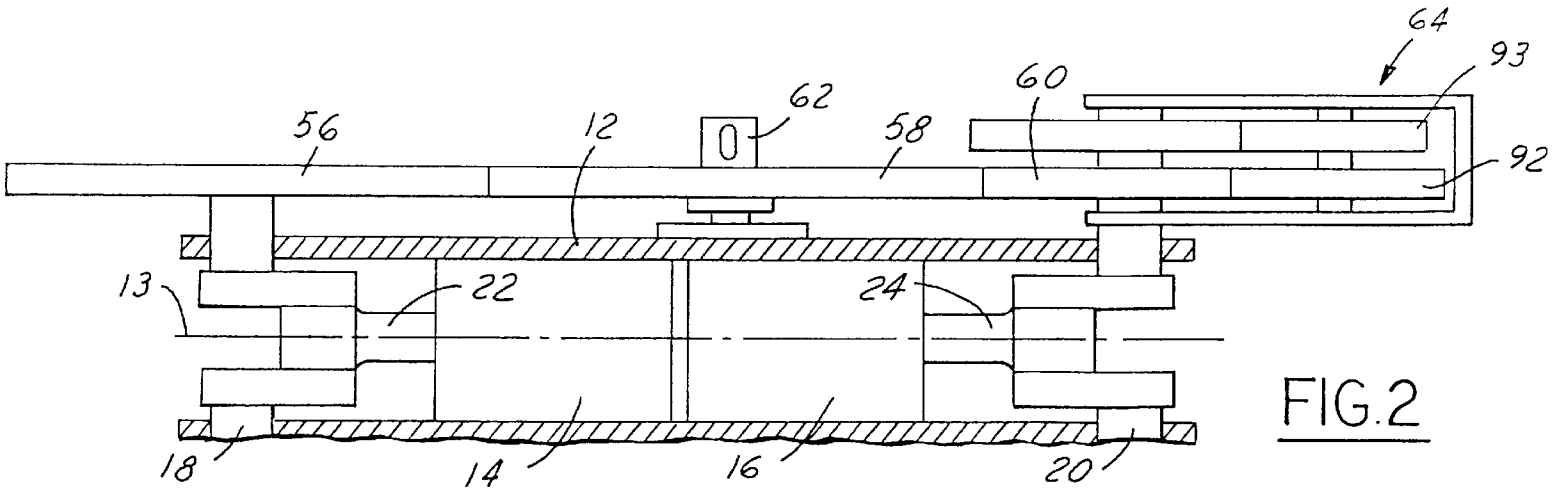
FIG. 2 is a partially cutaway view of a cylinder in a horizontal direction.

Referring now to FIGS. 1 and 2, a portion of an engine block 10 that is monoblock except for a removable piece 33 used in assisting insertion of the poppet valve, is shown having a combustion chamber or cylinder 12. Cylinder 12 has a longitudinal axis 13. Within cylinder 12 are a pair of reciprocating pistons 14 and 16. Pistons 14 and 16 have piston rings (not shown) for sealing the combustion chamber. Piston rings are commonly known and not within the scope of this application.

The pistons are coupled to crankshafts 18 and 20. Connecting rods 22 and 24 couple their respective pistons 14 and 16 to crankshafts 18 and 20. As crankshafts 18 and 20 rotate, pistons 14 and 16 are reciprocated within cylinder 12.

Cylinder 12 has a pocket 26 extending in a radial direction therefrom. Pocket 26 is "dead space" because the reciprocating movement of pistons 14 and 16 does not reach pocket 26. Dead space is preferably limited to around 6% or less of the total working volume of the cylinder. As will be described further below, pocket 26 is preferably also cylindrically shaped.

A valve train 28 is coupled to engine block 10. Valve train 28 has an intake valve 30 and an exhaust valve 32. Intake valve 30 and exhaust valve 32 are used for admitting fuel vapor into and removing combustion gases from cylinder 12. Intake valve 30 is coupled to an intake manifold (not shown) in a conventional manner. An exhaust valve 32 is coupled to an exhaust manifold (also not shown) in a conventional manner.

Valves 30 and 32 are coupled respectively to springs 36 and 38, pusher rods 40 and 42 and cams 44 and 46. Cams 44 and 46 are coupled to cam shafts 48 and 50. Cam shafts 48 and 50 may be coupled to crankshafts 18 and 20 through gearing (not shown). Movement of valves 30 and 32 is as follows: springs 36 and 38 bias valves 30 and 32 toward the closed position; as cams 44 and 46 rotate, cams 44 and 46 push against pusher rods 40 and 42 to overcome the force of springs 36 and 38 to open valves 30 and 32.

The phase of the valves corresponds with the combustion cycle of the engine. Although, there may be times at which intake and exhaust valves are slightly open at the same time.

Valves 30 and 32 have stems 52 and 54 generally defining a longitudinal axis therealong. Generally, it is preferred that longitudinal axis defined by stems 52 and 54 are parallel. It is most preferred that stems 52 and 54 are co-axial. Springs 36 and 38 are located around stems 52 and 54. When either valve 30 or 32 is fully opened, the opened valve extends nearly across pocket 26. In this manner, the space occupied by pocket 26 may be reduced since both valves are never fully opened simultaneously.

A spark plug 55 is coupled to pocket 26. Spark plug 55 extends partially into pocket 26 so as not to interfere with the movement of valves 30 and 32. Spark plug 55 is used to ignite the fuel vapor mixture within cylinder 12.

As shown best in FIG. 2, a number of gears are used to couple crankshaft 18 to crankshaft 20. In the configuration shown, crankshaft 18 is the driven crankshaft, while crankshaft 20 is free and moves in response to the gear set coupled to crankshaft 18. Crankshaft 18 is coupled to a first gear 56, a second gear 58 and a third gear 60. Gear 60 is coupled to crankshaft 20. Gear 58 is mounted to engine block 10 at a coupling 62. Gear 58 couples gear 56 to gear 60.

A phase shift mechanism 64 may be coupled to gear 60. Phase shift mechanism 64 allows gear 60 to move out of phase with gear 58. This allows the relative position of pistons 14 and 16 to change. The operation phase shift mechanism will be described further below.

Figure 3:
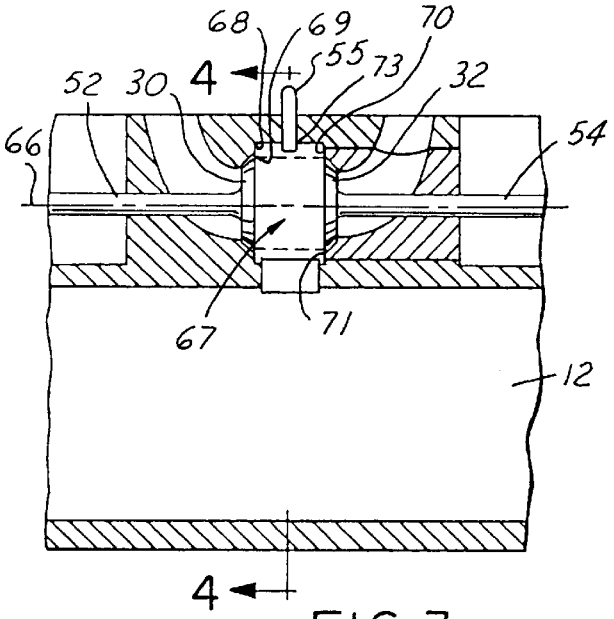
FIG. 3 is a partial cross sectional view in an axial direction of a cylinder and pocket.
Figure 4:
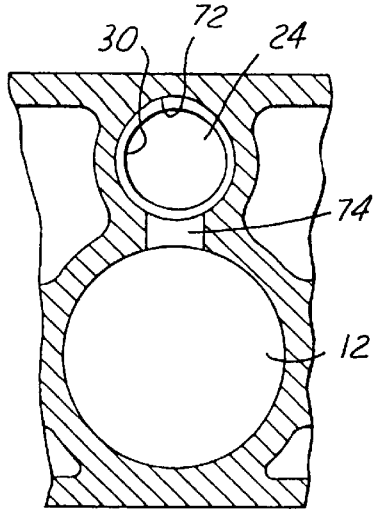
FIG. 4 is a partial cross sectional view of an engine block through the cylinder in an axial direction.

Referring now to FIGS. 3 and 4, valves 30 and 32 are shown having stems 52 and 54 with a common longitudinal axis 66. Longitudinal axis 66 is preferably parallel to longitudinal axis 13 of cylinder 12. Valves 30 and 32 move along longitudinal axis 66 when opening and closing. A common space 67 is utilized by each valve 30 and 32 as the valves open in turn. This minimal common space 67 is one advantage of this configuration.

Pocket 26 has end walls 68 and 70. End walls 68 and 70 are generally perpendicular to longitudinal axis 66. End walls 68 and 70 have openings 69 and 71, respectively for receiving valves 30 and 32. Valves 30 and 32 preferably form extensions of walls 68 and 70 when they are closed. A cylindrical wall 72 defines pocket 26 and extends between end walls 68 and 70. A port 74 couples pocket 26 to cylinder 12. Cylindrical wall 72 has an opening 73 for receiving spark plug 55.

A spark plug 55 is mounted within pocket 26 through cylindrical wall 72. Spark plug 55 is positioned to not interfere with the movement of the valves 30 and 32.

Figure 5:
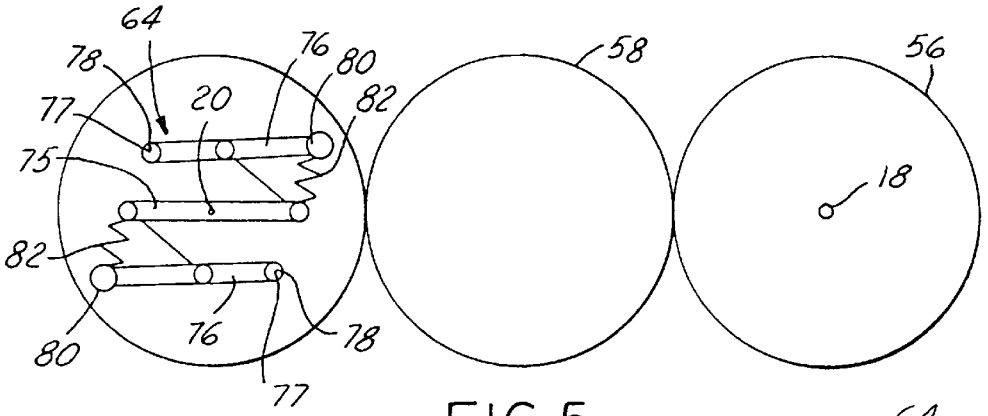
FIG. 5 is a schematic view of a first embodiment of a phase shift mechanism coupled to the engine.
Figure 7:
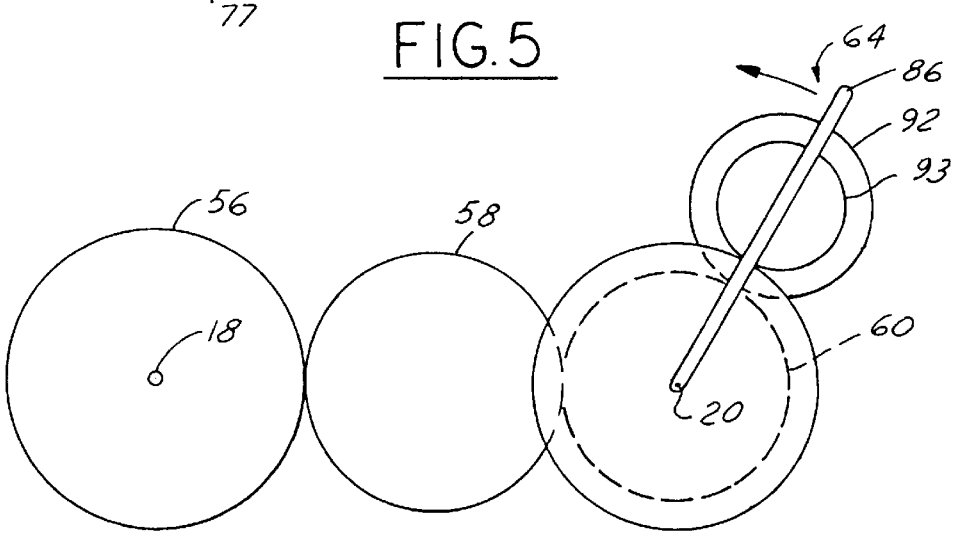
FIG. 7 is a schematic view of an alternative phase shift mechanism according to the present invention.
Figure 6:
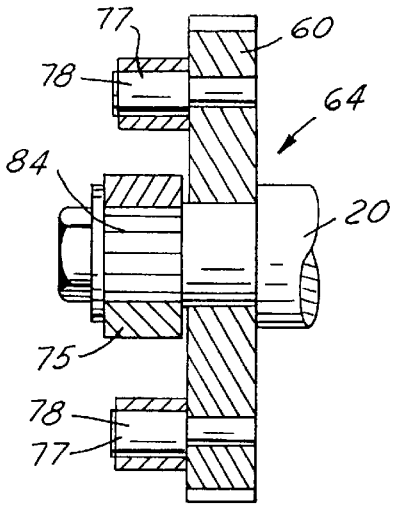
FIG. 6 is an axial cross sectional view of the phase shift mechanism of FIG. 5.
Figure 8:
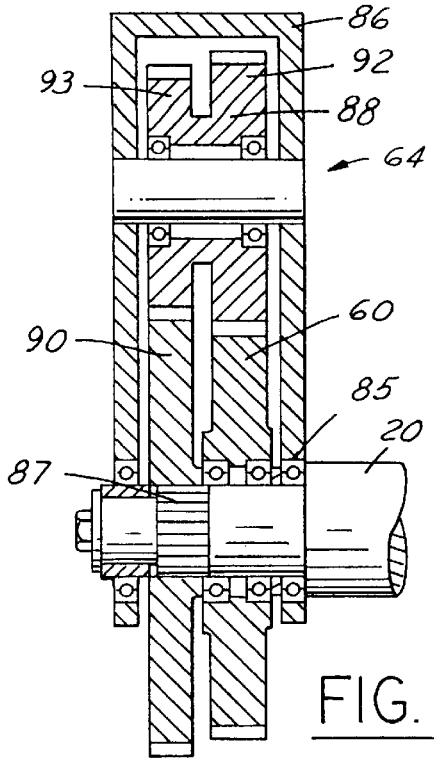
FIG. 8 is a partial cross sectional view of the phase shift mechanism of FIG. 7.

Referring now to FIGS. 5 and 6, a phase shift mechanism 64 is shown coupled to gear 60. Phase shift mechanism 64 acts to change the phase of crankshaft 20 with respect to crankshaft 18. Phase shift mechanism 64 is actuated by centrifugal force.

Phase shift mechanism 64 has a pair of levers 76 and a center lever 75 mounted to gear 60. One lever is coupled to crankshaft 20. Levers 76 are coupled by way of pins 78 to gear 60. One end of levers 76 have a hinge 77. On lever 76 opposite the end of hinges 77, a weight 80 is mounted thereto. Weights 80 pivots outwardly as the speed of rotation of gear 60 increases. Each of weights 80 are coupled to the center lever 75 by a spring 82. By using a pair of weights, the weights balance each other. Spring 82 resists the centrifugal force of mass 80. The tension of spring 82 and each weight 80 may be adjusted to provide the right amount of phase difference between gear 60 and gear 56.

Phase shift mechanism 64, as the gear 60 rotates, changes phase with respect to gear 56 depending on the speed of rotation of gear 60.

Hinges 77 are formed on gear 60 by pins 78. A spline 84 is used to couple center lever 75 to gear 60. Pin 78 and spline 84 allow the respective levers 76 and center lever 75 to pivot.

Referring now to FIGS. 1, 2, 7 and 8, an alternative phase shift mechanism 64 is shown. The phase shift mechanism 64 in this embodiment is a planetary gear arrangement. The planetary gear arrangement has a gear 60 as described above coupled to a bearing 85 of crankshaft 20. The planetary gear arrangement also has a gear 90 coupled to crankshaft 20 at spline 87.

A carrier 86 is also coupled to crankshaft 20. Carrier 86 couples a reducer gear 88 to gear 60 and gear 90. Carrier 86 moves through an angle a based on the absolute air pressure behind the throttle by a servomechanism or other device (not shown). The phase relationship ($\phi$) between the size of gear 60 and gear 56 is equal to $\phi$=(1—gear 60/gear 56)$\alpha$.

Reducer gear 88 has a first gear portion 92 and a second gear portion 93. First gear portion 92 couples with gear 60 and second gear portion 93 couples with gear 90. As the position of carrier 86 changes, the gears 60 and 90 change with respect to each other.

Figure 9A:
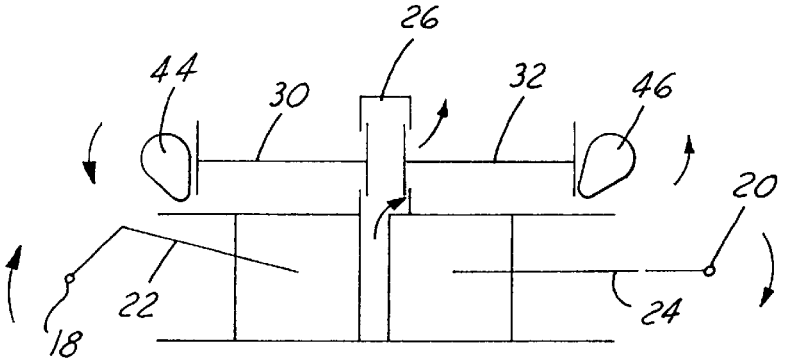
FIGS. 9*a* through 9*g* are schematic representations of the engine at various stages of the combustion cycle with a phase shift of 40 degrees between the two pistons.

Referring now to FIG. 9*a*, crankshaft 18 always lags crankshaft 20 by 40°. The compression degree is 10.4. Intake valve 30 is closed. Exhaust valve 32 is nearly closed. This illustrates the end of the exhaust cycle.

Figure 9B:
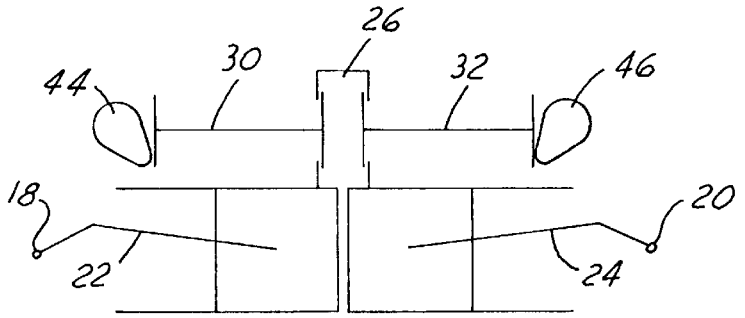

Referring now to FIGS. 9*b*, crankshaft 20 is positioned 20° after that of FIG. 9*a*. Intake valve 30 is just about to open. This is the maximum approach of the pistons 14 and 16.

Figure 9C:
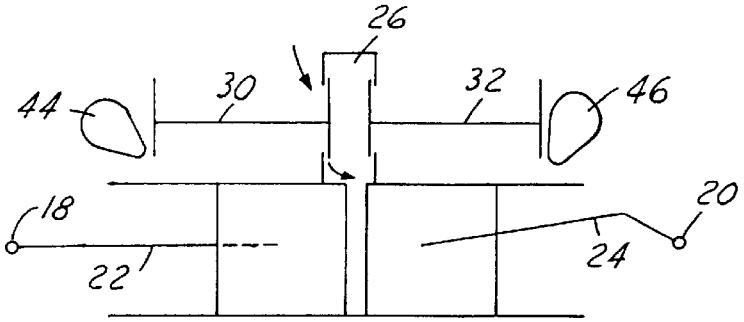

Referring now to FIG. 9*c*, crankshaft 20 is 40° beyond that of FIG. 9*a*. Intake valve 30 is partially opened. Exhaust valve 32 is closed.

Figure 9D:
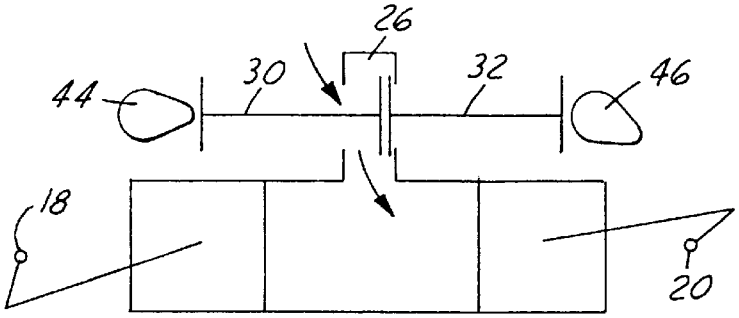

Referring now to FIG. 9*d*, crankshaft 20 is 140° beyond the position shown in FIG. 9*a*. Intake valve 30 is fully opened and has moved through common space 67 in pocket 26. Exhaust valve 32 is closed.

Figure 9E:
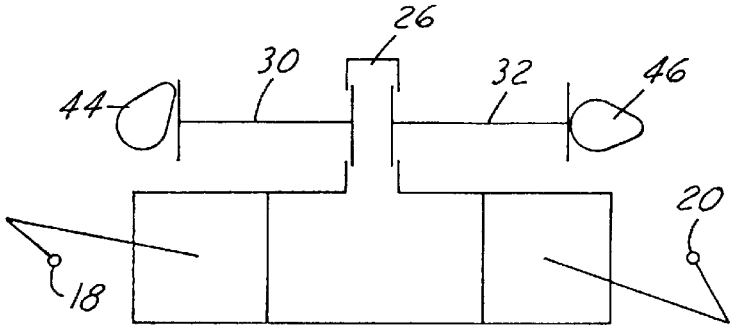

Referring now to FIG. 9*e*, crankshaft 20 is 250° beyond the position of FIG. 9*a*. Intake valve 30 is at its closing moment. Exhaust valve 32 is closed.

Figure 9F:
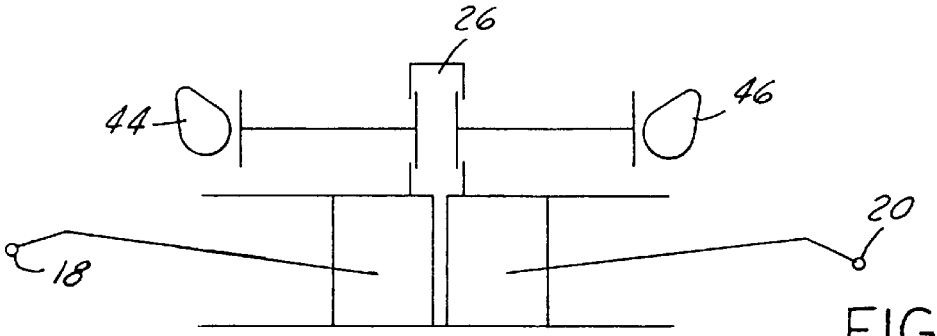
Figure 9G:
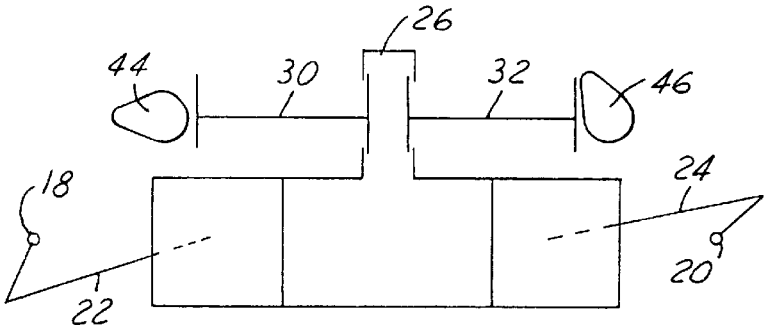

Referring now to FIG. 9*f*, crankshaft 20 is 380° beyond the position of FIG. 9*a*. The pistons are at their maximum compression at the moment of ignition.

Figure 10A:
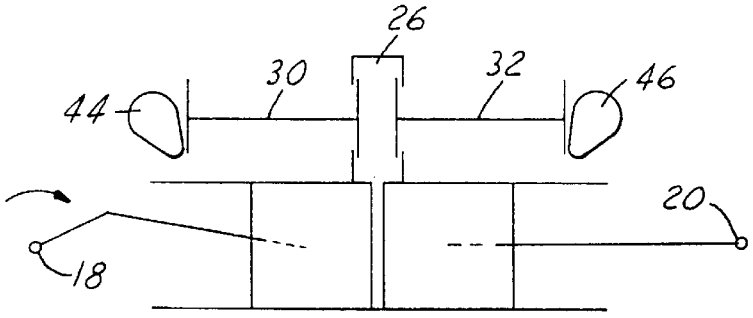
FIGS. 10*a* through 10*f* are schematic representations of the engine at various stages of the combustion cycle with a phase shift of 20 degrees between the two pistons.

Referring now to FIG. 10*a*, crankshaft 18 is the reference crankshaft. The crankshaft 20 lags crankshaft 18 by 20° throughout FIG. 10. The compression degree is 15. Intake valve 30 is just about to open. Exhaust valve 32 is just about to close.

Figure 10B:
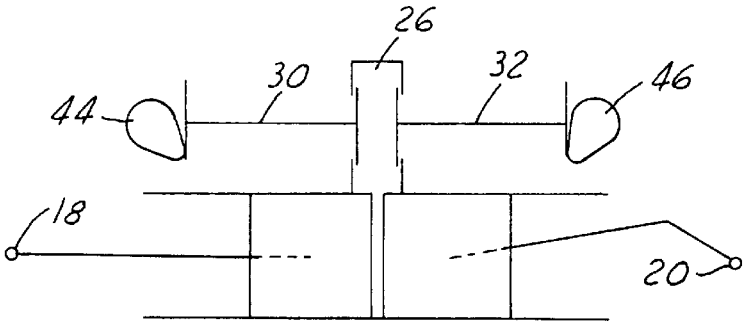

Referring now to FIG. 10*b*, crankshaft 20 is 20° beyond the position of FIG. 10*a*. Intake valve 30 is opening, drawing in fuel vapor mixture into cylinder 12. Between the positions of FIG. 10*a* and 10*b*, both valves are slightly opened, but do not interfere with each other since one is just closing and the other is just opening.

Figure 10C:
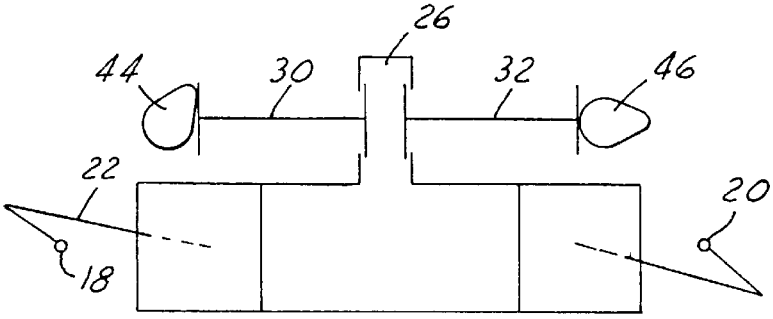

Referring now to FIG. 10*c*, both valves 30 and 32 are closed thus beginning the compression cycle.

Figure 10D:
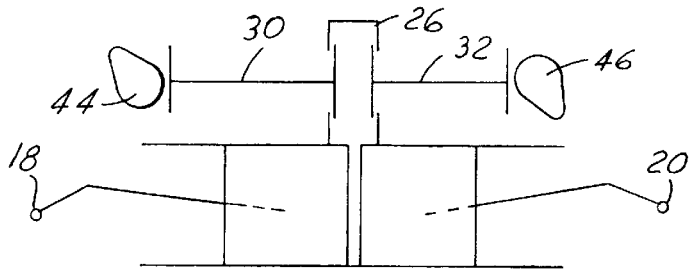

Referring now to FIG. 10*d*, the position of crankshaft 20 is 370° beyond that of FIG. 10*a*. Pistons 14 and 16 are at their closest position and valves 30 and 32 are closed.

Figure 10E:
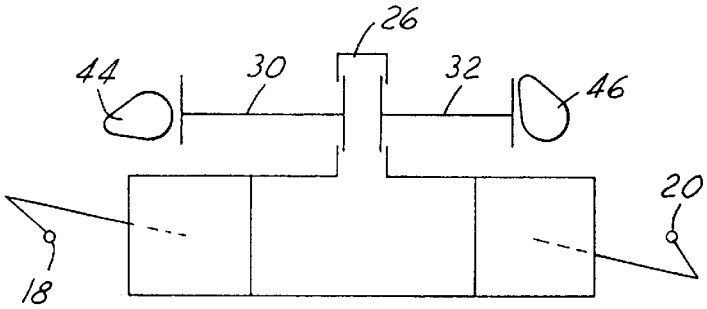

Referring now to FIG. 10*e*, the position of crankshaft 20 is 510° beyond the position of FIG. 10*a*. The power stroke or combustion stroke is occurring. The exhaust valve 32 is about to open and the intake valve is closed.

Figure 10F:
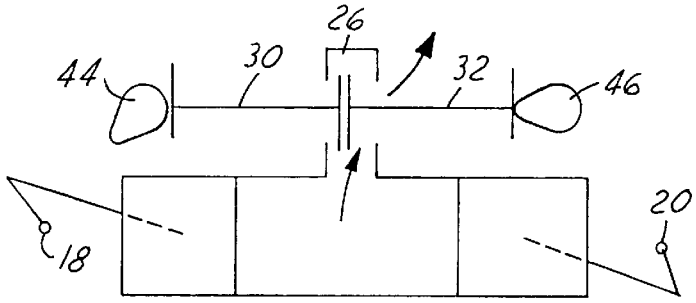

Referring now to FIG. 10*f*, the position of crankshaft 20 is 610° beyond that of FIG. 10*a*. Exhaust valve 32 is fully opened and intake valve 30 is closed.

Figure 11:
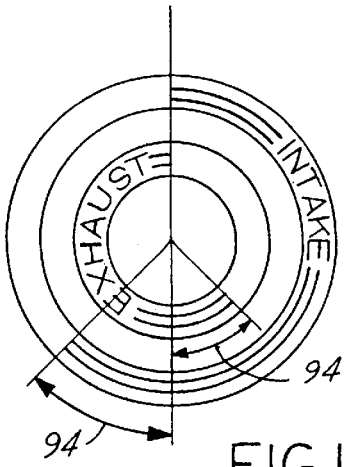
FIG. 11 is a graphical representation of the various portions of the cycle of the engine for a phase difference of 40 degrees.

Referring now to FIG. 11, the relative position of intake valve 30 and exhaust valve 32 are graphically represented for a phase angle of 40 degrees. Angles 94 are 45°

Figure 12:
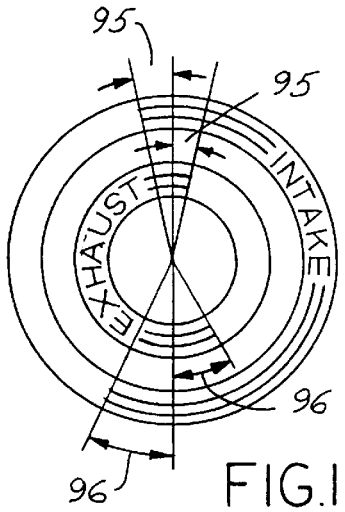
FIG. 12 is a graphical representation of the combustion cycle having a phase difference of 20 degrees.

Referring now to FIG. 12, the relative positions of the valves are illustrated for a phase shift of 20°. The angles 95 are 10° and the angles 96 are 35°.

During startup of the engine it is preferred to reduce the compression degree by increasing the phase difference. The phase of the engine may be varied during operation based on velocity torque or absolute pressure behind the throttle.

It should be understood by those skilled in the art that variations and modifications to the preferred embodiments described above may be made without departing from the true scope of the invention as defined by the following claims.

What is claimed is:

1. An engine having an engine block that is monoblock except for a removable piece used in assisting insertion of at least one valve, and including a cylinder having a longitudinal axis defined therein, said engine comprising:

a pocket extending from said cylinder, said pocket defining a dead space therein;

said pocket having a first wall spaced apart from a second wall, said first wall having a first opening, said second wall having a second opening and said pocket having a third wall coupled between said first and second walls, said third wall having an opening with a spark plug therein;

a first valve located within said first opening;

a second valve located within said second opening;

said pocket having a common space between said first wall and said second wall through which said first valve and said second valve move during operation, and said pocket has a longitudinal axis parallel to said longitudinal axis of said cylinder and said valves move along an axis parallel to said cylinder axis.

2. An engine as recited in claim 1, wherein said third wall is cylindrical.

3. An engine as recited in claim 1, wherein said first wall and second wall are perpendicular to said second longitudinal axis.

4. An engine as recited in claim 1, further comprising a phase shift mechanism coupled to said second crankshaft, said phase shift mechanism comprises a planetary gear arrangement with rigid gears rotative on rigid axes.

5. An engine as recited in claim 4, wherein said planetary gear arrangement comprises a carrier coupled to said second crankshaft; a first planetary gear coupled to said second crankshaft, a second planetary gear coupled to one of a plurality of gears coupling said first crankshaft to said second crankshaft, and a reducer gear supported by said carrier and coupling said first planetary gear to said second planetary gear.

6. An engine comprising:

an engine block that is monoblock except for a removable piece used in assisting insertion of at least one valve;

a cylinder defined within said block, said cylinder having a first longitudinal axis;

a first piston and a second piston disposed within said cylinder, said first piston being directly opposed to said second piston;

a first crankshaft coupled to said first piston;

a second crankshaft coupled to said second piston;

said first crankshaft coupled to said second crankshaft through a plurality of gears;

a pocket extending from said cylinder in radial direction, said pocket defining a dead space therein, said pocket having a second longitudinal axis parallel to said first longitudinal axis;

said pocket having a first wall spaced apart from a second wall, and a third wall coupled between said first wall and said second wall, said first wall having a first opening, said second wall having a second opening, and said third wall having a third opening;

a first valve located within said first opening, said first valve moving along an axis parallel to said cylinder first axis;

a second valve located within said second opening, said second valve moving along an axis parallel to said cylinder first axis; and a spark plug located within said third opening.

7. An engine as recited in claim 6, wherein said lever system comprises a second gear coupled to said second crankshaft, a first lever pivotally coupled to said second gear, a first mass pivotally coupled to said first lever, and second lever pivotally coupled to said second gear, a second mass pivotally coupled to said second lever, and a center lever coupled to said second gear, a first spring coupled between said first lever and said center lever and a second spring coupled between said second lever and said center lever.

8. An engine as recited in claim 6, wherein said third wall is cylindrical.

9. An engine as recited in claim 6, wherein said first wall and second wall are perpendicular to said longitudinal axis.

10. An engine as recited in claim 6, further comprising a phase shift mechanism coupled to said second crankshaft, wherein said phase shift mechanism comprises a planetary gear arrangement with rigid gears with rigid axis.

11. An engine as recited in claim 10, wherein said planetary gear arrangement comprises a carrier coupled to said second crankshaft; a first planetary gear coupled to said second crankshaft, a second planetary gear coupled to one of said plurality of gears coupling said first crankshaft to said second crankshaft, and a reducer gear supported by said carrier and coupling said first planetary gear to said second planetary gear.

12. An engine comprising:

an engine block;

a cylinder defined within said block, said cylinder having a longitudinal axis;

a first piston and a second piston disposed within said cylinder, said first piston being directly opposed to said second piston;

a first crankshaft coupled to said first piston;

a second crankshaft coupled to said second piston;

said first crankshaft coupled to said second crankshaft through a plurality of gears;

a pocket extending from said cylinder in radial direction, said pocket defining a dead space therein;

said pocket having a first wall spaced apart from a second wall, and a third wall coupled between said first wall and said second wall, said first wall having a first opening, said second wall having a second opening, and said third wall having a third opening;

a first valve located within said first opening;

a second valve located within said second opening;

a spark plug located within said third opening; and a centrifugal lever system phase shift mechanism coupled to said second crankshaft.

13. An engine comprising:

an engine block that is monoblock except for a removable piece used in assisting insertion of at least one valve;

a cylinder defined within said engine block having a first longitudinal axis;

a first piston and a second piston disposed within said cylinder, said first piston being directly opposed to said second piston;

a first crankshaft coupled to said first piston;

a second crankshaft coupled to said second piston;

said first crankshaft coupled to said second crankshaft through a plurality of gears;

a pocket defined within said engine block, said pocket having a second longitudinal axis parallel to and spaced apart from said first longitudinal axis, said pocket having a spark plug opening;

a spark plug located in said spark plug opening;

a port coupling said first cylinder to said pocket;

a pair of valves disposed within said pocket, said valves moving along said second longitudinal axis; and a phase shift mechanism coupled to said second crankshaft, said phase shift mechanism changing a phase between said first crankshaft and said second crankshaft.

14. An engine as recited in claim 13, wherein said pocket is shaped as a cylindrical and has a first perpendicular end wall and a second perpendicular end wall, one of said pair of valves being received within said first end wall, the other one of said pair of valves being received within said second wall and, wherein a spark plug is disposed within said pocket.

15. An engine as recited in claim 13, wherein said phase shift mechanism comprises a planetary gear arrangement with rigid gears rotative on rigid axes.

16. An engine as recited in claim 15, wherein said planetary gear arrangement comprises a carrier coupled to said second crankshaft; a first planetary gear coupled to said second crankshaft, a second planetary gear coupled to one of said plurality of gears coupling said first crankshaft to said second crankshaft, and a reducer gear supported by said carrier and coupling said first planetary gear to said second planetary gear.

17. An engine as recited in claim 12, wherein said lever system comprises a second gear coupled to said second crankshaft, a first lever pivotally coupled to said second gear, a first mass pivotally coupled to said first lever, and second lever pivotally coupled to said second gear, a second mass pivotally coupled to said second lever, and a center lever coupled to said second gear a first spring coupled between said first lever and said center lever and a second spring coupled between said second lever and said center lever.

18. An engine having an engine block and cylinder having a longitudinal axis defined therein, said engine comprising:

a pocket extending from said cylinder, said pocket defining a dead space therein;

said pocket having a first wall spaced apart from a second wall, said first wall having a first opening, said second wall having a second opening;

a first valve located within said first opening;

a second valve located within said second opening;

said pocket having a common space between said first wall and said second wall through which said first valve and said second valve move during operation; and a centrifugal lever system phase shift mechanism coupled to said second crankshaft.

19. An engine as recited in claim 12, wherein said lever system comprises a second gear coupled to said second crankshaft, a first lever pivotally coupled to said second gear, a first mass pivotally coupled to said first lever, and second lever pivotally coupled to said second gear, a second mass pivotally coupled to said second lever, and a center lever coupled to said second gear, a first spring coupled between said first lever and said center lever and a second spring coupled between said second lever and said center lever.

20. An engine comprising:

an engine block;

a cylinder defined within said engine block having a first longitudinal axis;

a first piston and a second piston disposed within said cylinder, said first piston being directly opposed to said second piston;

a first crankshaft coupled to said first piston;

a second crankshaft coupled to said second piston;

said first crankshaft coupled to said second crankshaft through a plurality of gears;

a pocket defined within said engine block, said pocket having a second longitudinal axis parallel to and spaced apart from said first longitudinal axis;

a port coupling said first cylinder to said pocket;

a pair of valves disposed within said pocket, said valves moving along said second longitudinal axis; and a centrifugal lever system phase shift mechanism coupled to said second crankshaft, said phase shift mechanism changing a phase between said first crankshaft and said second crankshaft.

* * * * *